US008727798B2

(12) United States Patent
Huo et al.

(10) Patent No.: US 8,727,798 B2
(45) Date of Patent: May 20, 2014

(54) COAXIAL CONNECTOR AND METHOD FOR PROVIDING NORMAL FORCE IN ELECTRICAL CONNECTOR

(75) Inventors: Zhudong Huo, Guangzhou (CN); Yongbo Deng, Guangzhou (CN); Defang Hu, Guangzhou (CN); Wen Wei Lin, Guangzhou (CN)

(73) Assignee: Lotes Co., Ltd., Keelung (TW)

( * ) Notice: Subject to any disclaimer, the term of this patent is extended or adjusted under 35 U.S.C. 154(b) by 157 days.

(21) Appl. No.: 13/495,501

(22) Filed: Jun. 13, 2012

(65) Prior Publication Data

US 2013/0288497 A1 Oct. 31, 2013

(30) Foreign Application Priority Data

Apr. 26, 2012 (CN) ..... 2012 1 0125143

(51) Int. Cl.
*H01R 29/00* (2006.01)
*H01R 13/703* (2006.01)

(52) U.S. Cl.
CPC ..... *H01R 13/7032* (2013.01)
USPC ..... 439/188

(58) Field of Classification Search
CPC .. H01R 2103/00; H01R 13/7032; F12S 4/001
USPC ..... 439/63, 188; 200/51.1
See application file for complete search history.

(56) References Cited

U.S. PATENT DOCUMENTS

| | | | | |
|---|---|---|---|---|
| 6,554,630 | B2 * | 4/2003 | Uratani | 439/188 |
| 6,751,317 | B2 * | 6/2004 | Shima et al. | 379/438 |
| 6,761,571 | B2 * | 7/2004 | Hida | 439/188 |
| 6,873,673 | B2 * | 3/2005 | Georgii | 376/272 |
| 7,513,778 | B1 * | 4/2009 | Dar-Shan | 439/63 |
| 8,038,450 | B2 * | 10/2011 | Nakagawa | 439/63 |

* cited by examiner

*Primary Examiner* — Phuong Dinh
(74) *Attorney, Agent, or Firm* — Morris Manning & Martin LLP; Tim Tingkang Xia, Esq.

(57) ABSTRACT

A coaxial connector and a method for providing a normal force in an electrical connector. The coaxial connector includes a first terminal having a first contact portion and a second terminal having a second contact portion. Before an external device is inserted into the coaxial connector for the first time, the first contact portion and the second contact portion form a first relative positional relationship. After the external device is disengaged from the coaxial connector, the second contact portion urges against the first contact portion upwards to form a third relative positional relationship. The third relative positional relationship is different from the first relative positional relationship.

17 Claims, 7 Drawing Sheets

COAXIAL CONNECTOR AND METHOD FOR PROVIDING NORMAL FORCE IN ELECTRICAL CONNECTOR

CROSS-REFERENCE TO RELATED APPLICATION

This non-provisional application claims priority under 35 U.S.C. §119(a) on Patent Application No. 201210125143.6 filed in P.R. China on Apr. 26, 2012, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to a coaxial connector, and more particularly to a coaxial connector having a switch.

BACKGROUND OF THE INVENTION

A coaxial connector in the related art includes an insulating casing, which has a cavity for receiving a coupling plug to be inserted therein from top to bottom. A fixed terminal and a movable terminal are fixed within the insulating casing to respectively enter the cavity. Before receiving a coupling plug, a free end of the movable terminal is located below a contact portion of the fixed terminal, and applies an elastic pressing force to the contact portion of the fixed terminal, so that the two are in close contact with each other. When the coupling plug is inserted downwards into the cavity and urges against the movable terminal, the free end of the movable terminal is detached from the contact portion of the fixed terminal, so as to implement a switch function. If it is intended to mount and fix such a coaxial connector onto a circuit board, the coaxial connector is first placed in a soldering stove, and then heated to be fixed by soldering to the circuit board. Since the insulating casing is usually made of a plastic material, the insulating casing is easily softened when heated at a high temperature. At this time, in a case that a part of the insulating casing below the movable terminal is softened, a corresponding part of the movable terminal is inclined downwards and falls down easily, resulting in that the elastic pressing force applied by the free end of the movable terminal to the contact portion of the fixed terminal is reduced, or even that such a press-fit connection is released. Then, after the coaxial connector is soldered to the circuit board, the insulating casing is cooled and solidified, and accordingly, the movable terminal contacts the fixed terminal with a small elastic pressing force or is completely disengaged from the fixed terminal. That is, the upward normal force applied by the free end of the movable terminal to the contact portion of the fixed terminal is insufficient, resulting in poor contact between the movable terminal and the fixed terminal, which further affects the electrical conduction function.

Therefore, a heretofore unaddressed need exists in the art to address the aforementioned deficiencies and inadequacies.

SUMMARY OF THE INVENTION

In one aspect, the present invention is directed to a coaxial connector, which ensures that a sufficient normal pressing force is provided between two terminals to achieve stable conduction therebetween.

In one embodiment, a coaxial connector, for being soldered to a circuit board and capable of receiving an external device to be inserted therein, includes a receiving cavity, a first terminal and a second terminal. The receiving cavity is provided with an inserting interface for receiving the external device. The first terminal is mounted and fixed within the receiving cavity, and provided with a first soldering portion and at least one first contact portion. The first soldering portion is used for being soldered to the circuit board. The second terminal is mounted and fixed within the receiving cavity, and provided with a second soldering portion and at least one second contact portion. The second soldering portion is used for being soldered to the circuit board. Before the external device is inserted into the coaxial connector for the first time, the first contact portion and the second contact portion form a first relative positional relationship. Each time when the external device is inserted into the coaxial connector, the external device presses against and contacts the second contact portion downwards, so that the second contact portion is detached from the first contact portion, and the first contact portion and the second contact portion form a second relative positional relationship.

In another embodiment, a coaxial connector, for being soldered to a circuit board and capable of receiving an external device to be inserted therein, includes a receiving cavity, a first terminal and a second terminal. The receiving cavity is provided with an inserting interface for receiving the external device. The first terminal is mounted and fixed within the receiving cavity, and provided with a first soldering portion soldered to the circuit board and at least one first contact portion. The second terminal is mounted and fixed within the receiving cavity, and provided with a second soldering portion soldered to the circuit board and at least one second contact portion. When the coaxial connector is in normal operation and the external device is not inserted, the second contact portion presses against the first contact portion, and the first contact portion and the second contact portion form a relative positional relationship. Before the coaxial connector is fixed to the circuit board by soldering, the first contact portion and the second contact portion do not contact in the relative positional relationship. Each time after the external device is disengaged from the coaxial connector, the second contact portion urges against the first contact portion upwards to form a third relative positional relationship, the third relative positional relationship being different from the first relative positional relationship.

Further, the first relative positional relationship is that the second contact portion clamps the first contact portion.

Further, a front end of the second contact portion is provided with two fingers, and the first relative positional relationship is that the two fingers clamp the first contact portion.

Further, the first relative positional relationship is that the second contact portion is lap joined on a top surface of the first contact portion.

Further, the first relative positional relationship is that the second contact portion laterally urges against the first contact portion.

Further, the first relative positional relationship is that the second contact portion is suspended above the first contact portion.

In a further embodiment, an electrical connector includes a receiving cavity, and a first terminal and a second terminal, respectively mounted within the receiving cavity. The first terminal has at least one first contact portion, and the second terminal has at least one second contact portion. After the electrical connector is fixed to a circuit board by soldering, a relative positional relationship between the first contact portion and the second contact portion before soldering is changed, and a prestress is formed between the first contact portion and the second contact portion, so as to provide a normal force for enabling the first contact portion to urge against the second contact portion, so that electrical connection between the first contact portion and the second contact portion is maintained by the normal force during operation of the electrical connector.

Further, after the relative positional relationship between the first contact portion and the second contact portion before soldering is changed, the second contact portion urges against the first contact portion upwards.

Further, the electrical connector is used for receiving an external device to be inserted therein. When the external device is inserted into the electrical connector, the second contact portion is detached from the first contact portion to form an open circuit. After the external device is disengaged from the electrical connector, the second contact portion urges against the first contact portion upwards.

Further, before the electrical connector is fixed to the circuit board by soldering, the second contact portion clamps the first contact portion.

Further, before the electrical connector is fixed to the circuit board by soldering, the second contact portion is lap joined on the first contact portion.

Further, before the electrical connector is fixed to the circuit board by soldering, the second contact portion is suspended above the first contact portion.

Further, before the electrical connector is fixed to the circuit board by soldering, the second contact portion laterally urges against the first contact portion.

In yet another embodiment, a method for providing a normal force in an electrical connector is provided. The electrical connector includes a first terminal and a second terminal. The first terminal has at least one first contact portion, and the second terminal has at least one second contact portion. After the electrical connector is fixed to a circuit board by soldering, an urging state between the first contact portion and the second contact portion before soldering is changed, and a prestress is formed between the first terminal and the second terminal, so as to provide a normal force for maintaining electrical connection between the first contact portion and the second contact portion during operation of the electrical connector.

Further, after the electrical connector is fixed to a circuit board by soldering, the urging state between the first contact portion and the second contact portion before soldering is changed by inserting an external device for the first time.

Further, after the urging state between the first contact portion and the second contact portion before soldering is changed, the second contact portion urges against the first contact portion upwards.

Further, the electrical connector is used for receiving an external device to be inserted therein. When the external device is inserted into the electrical connector, the second contact portion is detached from the first contact portion to form an open circuit. After the external device is disengaged from the electrical connector, the second contact portion urges against the first contact portion upwards.

As compared with the related art, in the coaxial connector and the method for providing a normal force in an electrical connector of the present invention, before the external device is inserted into the coaxial connector for the first time, the first contact portion and the second contact portion form a first relative positional relationship. Each time when the external device is inserted into the coaxial connector, the external device presses against and contacts the second contact portion downwards, so that the second contact portion is located below the first contact portion, and the first contact portion and the second contact portion form a second relative positional relationship. Each time after the external device is disengaged from the coaxial connector, the second contact portion urges against the first contact portion upwards to form a third relative positional relationship. Whereby, when the coaxial connector is placed in a high-temperature soldering stove for soldering, even if the insulating body is softened under heat, that is, a part of the insulating body below the second terminal is softened, the corresponding part of the second terminal can be prevented from being inclined downwards and falling down, so that after the insulating body is cooled and solidified after soldering, the second contact portion urges against the first contact portion upwards with a sufficient contact normal force, thereby ensuring good electrical conduction between the first terminal and the second terminal.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
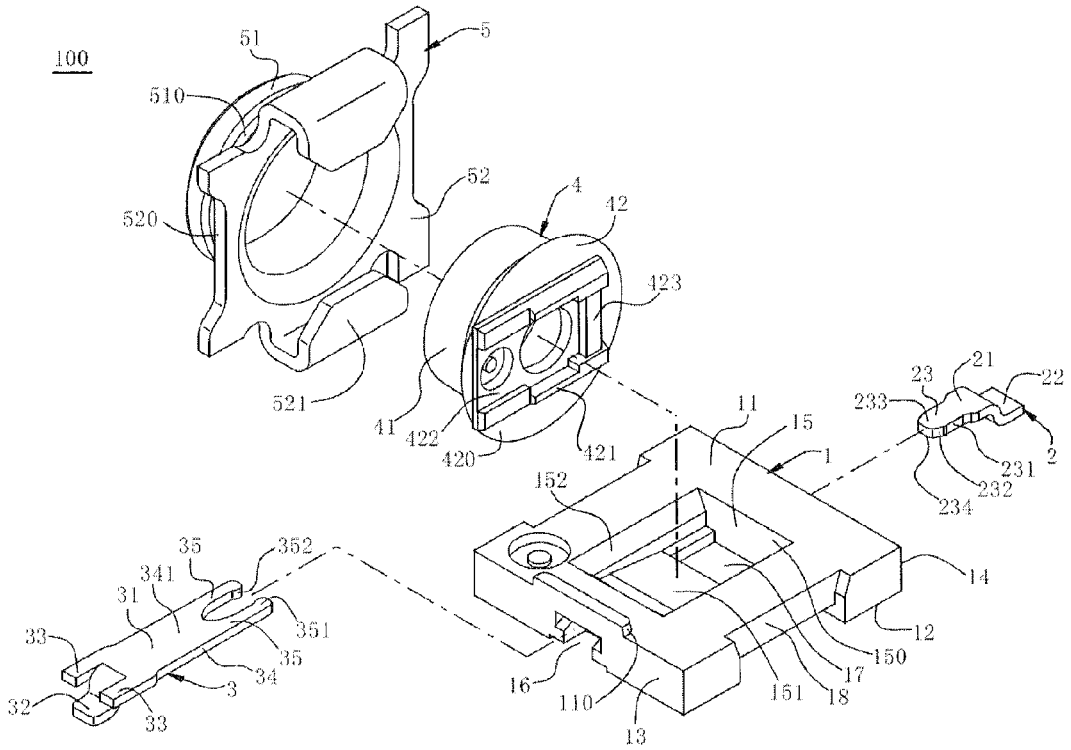
FIG. 1 is a schematic three-dimensional exploded view of a coaxial connector according to the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

Figure 2:
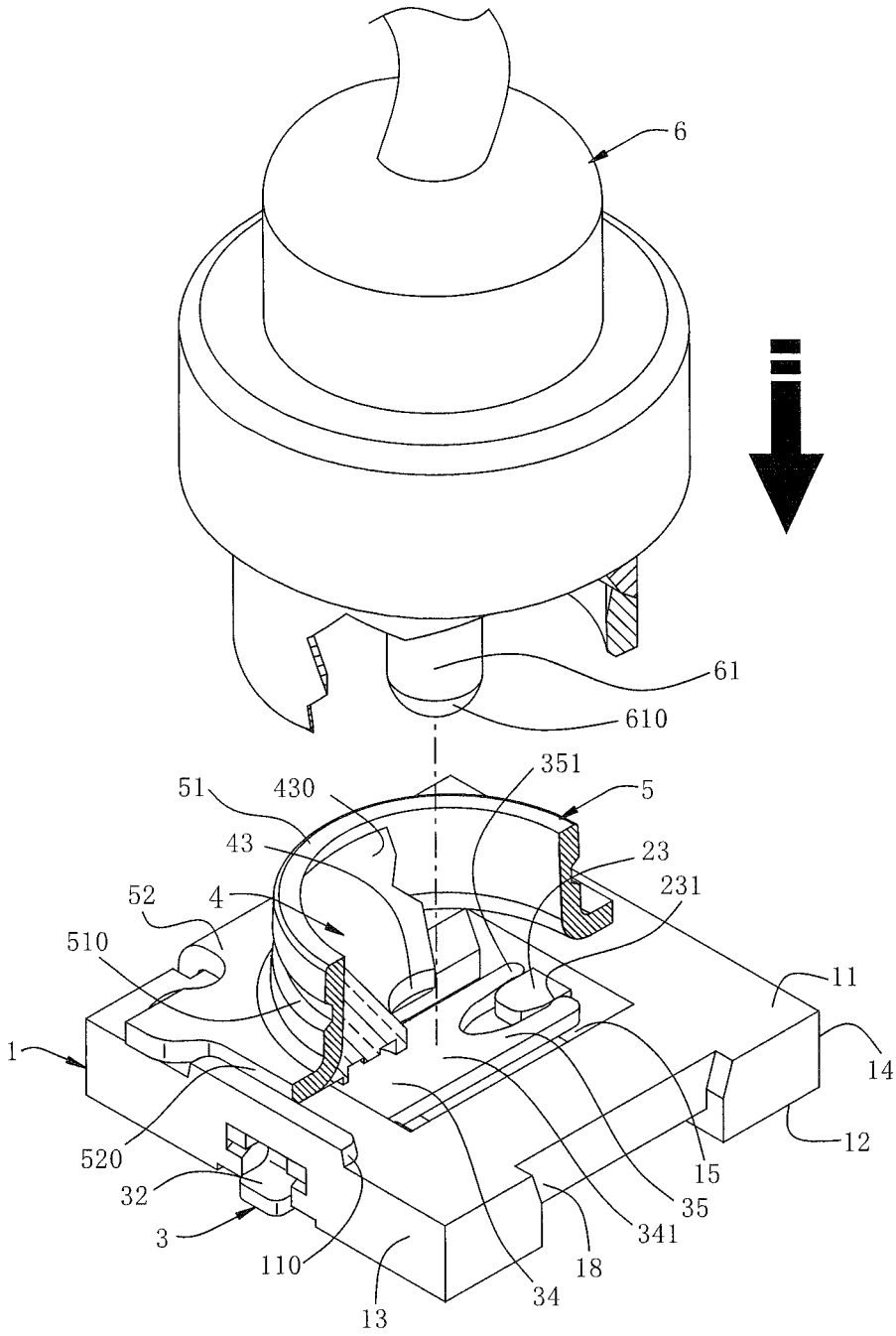
FIG. 2 is a schematic three-dimensional view of the coaxial connector according to the present invention, when no external device is inserted.

Referring to FIGS. 1 and 2, a coaxial connector 100 according to one embodiment of the present invention includes an insulating body 1, a first terminal 2, a second terminal 3, a top cover 4 and a casing 5. The coaxial connector 100 is fixed to a circuit board (not shown) by soldering, and used for receiving an external device 6 to be inserted therein.

Referring now to FIG. 1, the insulating body 1 is square-shaped, and has a top surface 11, a bottom surface 12, a left side surface 13 and a right side surface 14. The top surface 11 is recessed downwards at the center thereof to form a receiving cavity 15. The top of the receiving cavity 15 has an inserting interface 150. The bottom of the receiving cavity 15 is provided with an inclined wall 151, which is a plane gradually inclined downwards from left to right. Front and rear walls of the receiving cavity 15 are provided with two chamfers 152 adjacent to the top surface 11. The two chamfers 152 connect left and right walls of the receiving cavity 15. The top surface 11 protrudes to form an elongated reinforcing rib 110 adjacent to the left side surface 13. The left side surface 13 is recessed inwards below the reinforcing rib 110 to form an accommodating hole 16. The accommodating hole 16 is in lateral communication with the receiving cavity 15. The bottom surface 12 is recessed upwards adjacent to the right side surface 14 to form a through hole 17. The through hole 17 is in vertical communication with the receiving cavity 15. In addition, front and rear sides of the insulating body 1 are respectively recessed to form a notch 18, and the notch 18 is substantially in a trapezoid shape with a wide upper base and a narrow lower base.

Referring to FIG. 1, the first terminal 2 is formed by stamping a metal plate into a Z-shape, and has a first body portion 21. One end of the first body portion 21 is bent downwards and extends horizontally to form a first soldering portion 22. The other end of the first body portion 21 extends horizontally to form a first contact portion 23. The first contact portion 23 shrinks in a forward direction, and two opposite outer sides of the first contact portion 23 are provided with two pressed portions 231, and two guiding surfaces 232 disposed at front ends of the pressed portion 231. A lap joint portion 233 is disposed on a top surface of the first contact portion 23, and two first urging portions 234 are disposed on a bottom surface of the first contact portion 23.

Referring to FIGS. 1 and 2, the second terminal 3 is also formed by stamping a metal plate into a Z-shape, and has a second body portion 31. The second body portion 31 is in a flat plate shape. One end of the second body portion 31 is bent downwards and extends to form a second soldering portion 32, and the second body portion 31 extends horizontally on two sides of the second soldering portion 32 to form two fixing portions 33. The two fixing portions 33 are used for being connected to strips. In this embodiment, the other end of the second body portion 31 extends horizontally to form a second contact portion 34, and a front end of the second contact portion 34 is provided with a C-shaped opening so that two fingers 35 are formed. Two second urging portions 351 are disposed on top surfaces of the two fingers 35, and two clamping portions 352 are disposed on inner side surfaces of the two fingers 35. In addition, a top surface of the second contact portion 34 further has a third urging portion 341 for urging against the external device 6. In other embodiments, the second contact portion 34 may be in an L-shape or other shapes, and the number of the second contact portion 34 may be two or more.

Referring to FIGS. 1 and 2, the top cover 4 is injection molded from an insulating material. The top cover 4 includes a cylinder 41 and a bottom plate 42, and the cylinder 41 smoothly transitions to and is vertically coupled to the bottom plate 42. A circular coupling hole 43 is formed at the center of the cylinder 41, and a hole wall of the coupling hole 43 is an inverted cone-shaped camber 430, so that the diameter of the coupling hole 43 gradually decreases from top to bottom. The bottom plate 42 has a bottom surface 420, and two positioning blocks 421 disposed on the bottom surface 420 in a front-rear manner. Outsides of the two positioning blocks 421 are inclined. A groove 422 is formed between the two positioning blocks 421. The groove 422 is in vertical communication with the coupling hole 43, and the groove 422 has a width greater than that of the first terminal 2 and the second terminal 3. A stop wall 423 is disposed at a right side of the groove 422 to connect the two positioning blocks 421.

Figure 3:
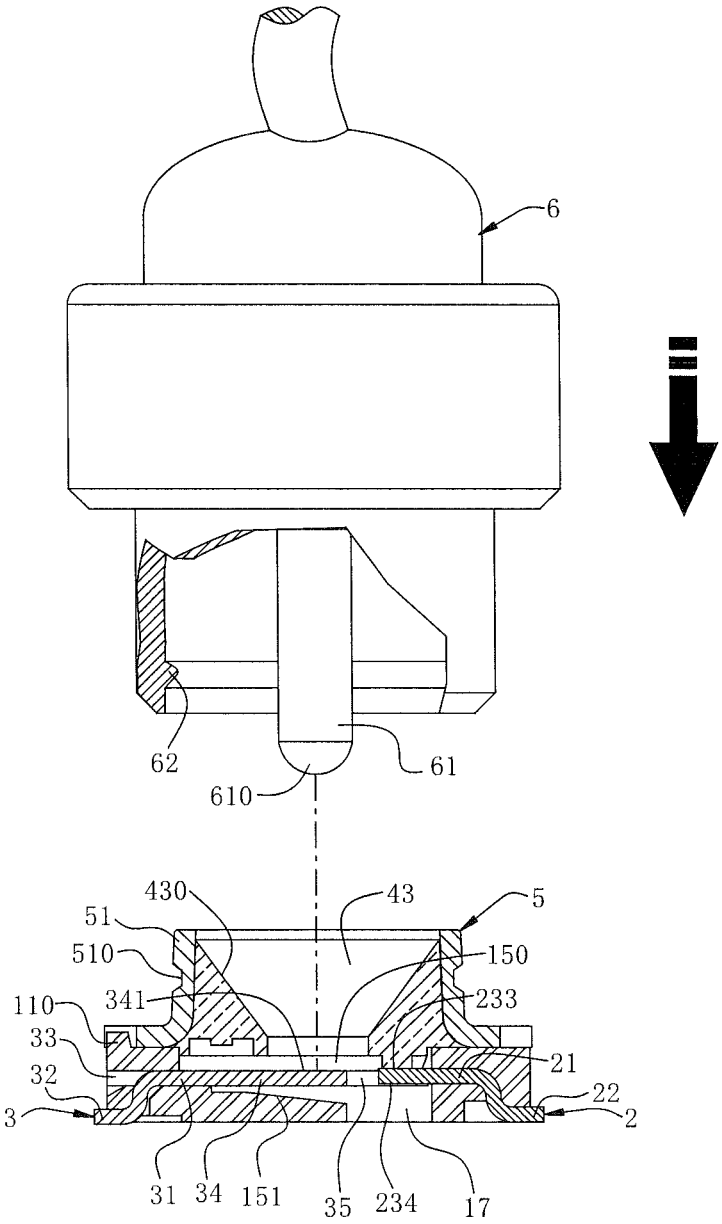
FIG. 3 is a sectional view of FIG. 2.
Figure 4:
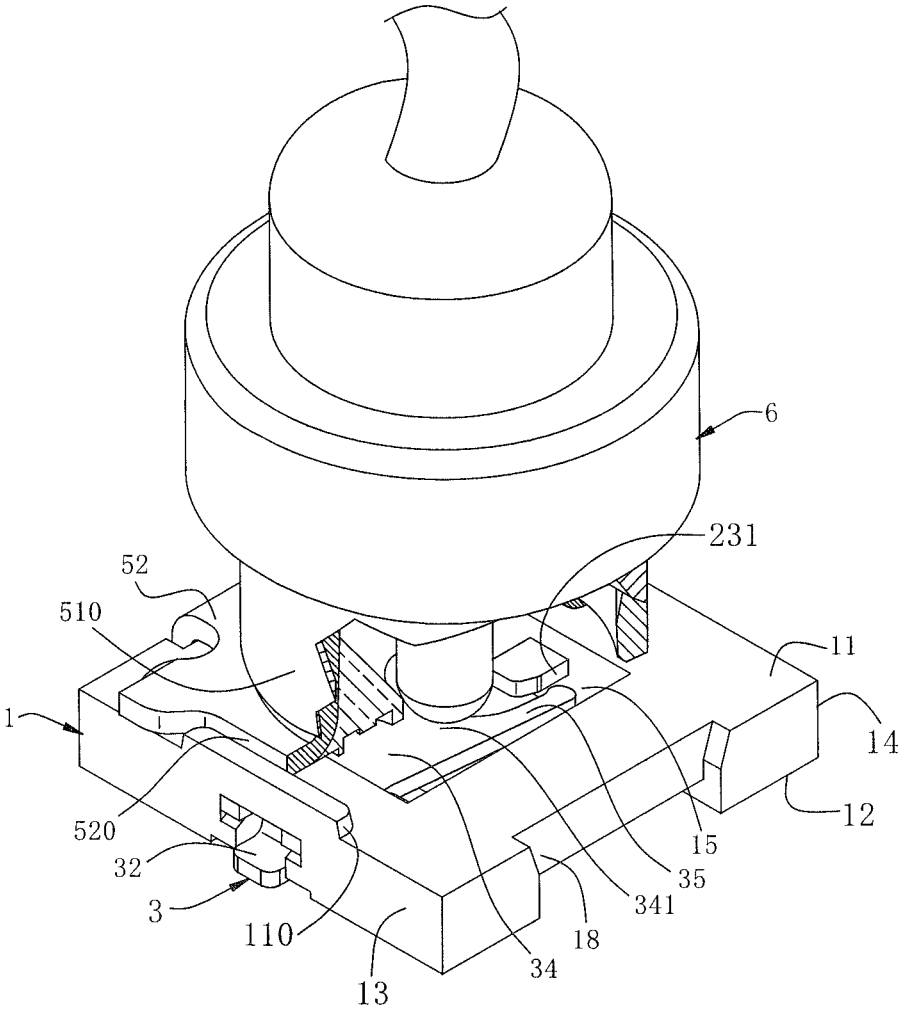
FIG. 4 is a schematic three-dimensional view of the coaxial connector according to the present invention, when an external device is inserted.
Figure 5:
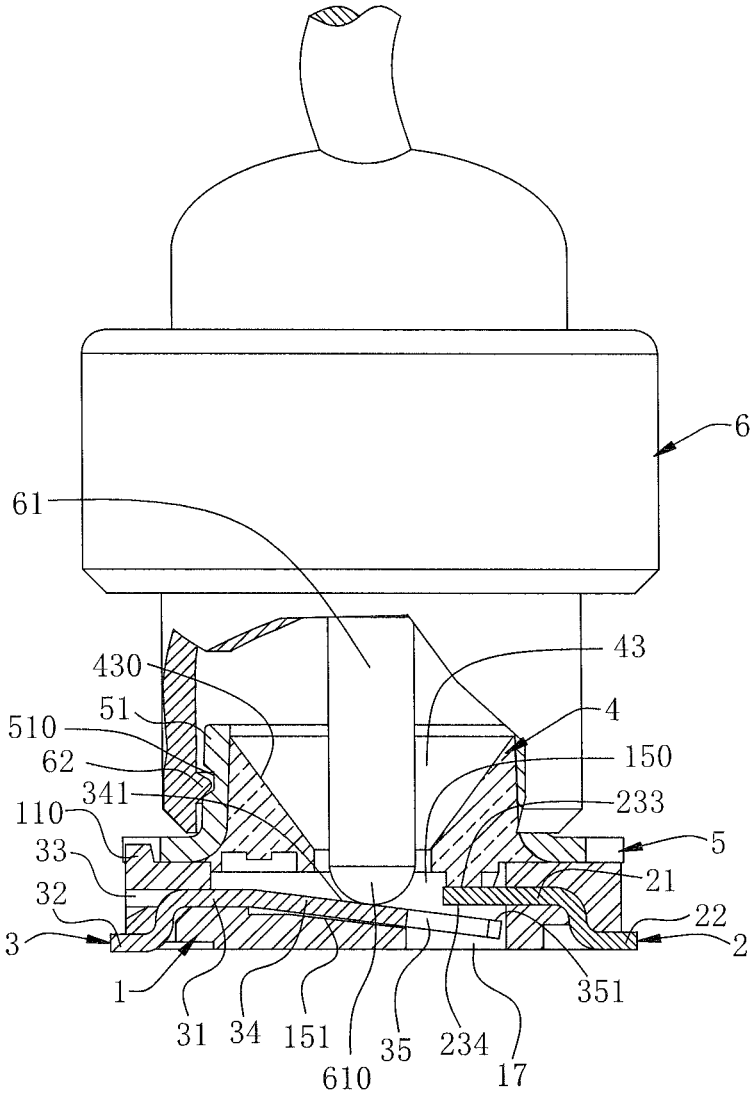
FIG. 5 is a sectional view of FIG. 4.
Figure 6:
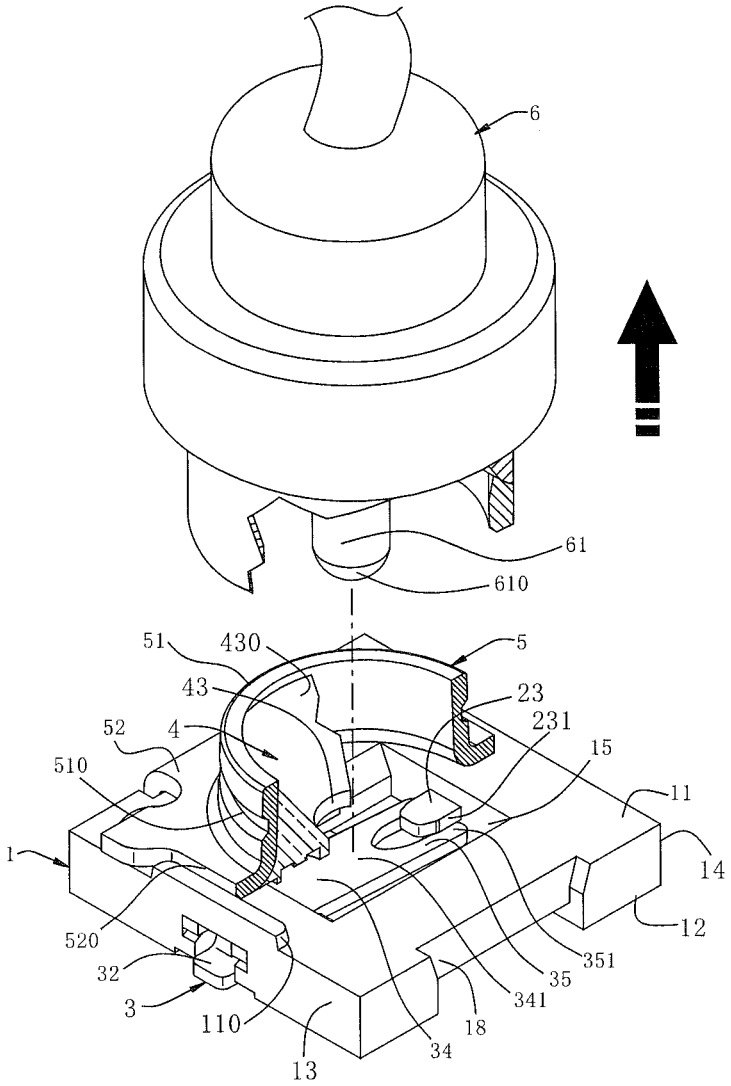
FIG. 6 is a schematic three-dimensional view of the coaxial connector according to the present invention, when the external device is removed.
Figure 7:
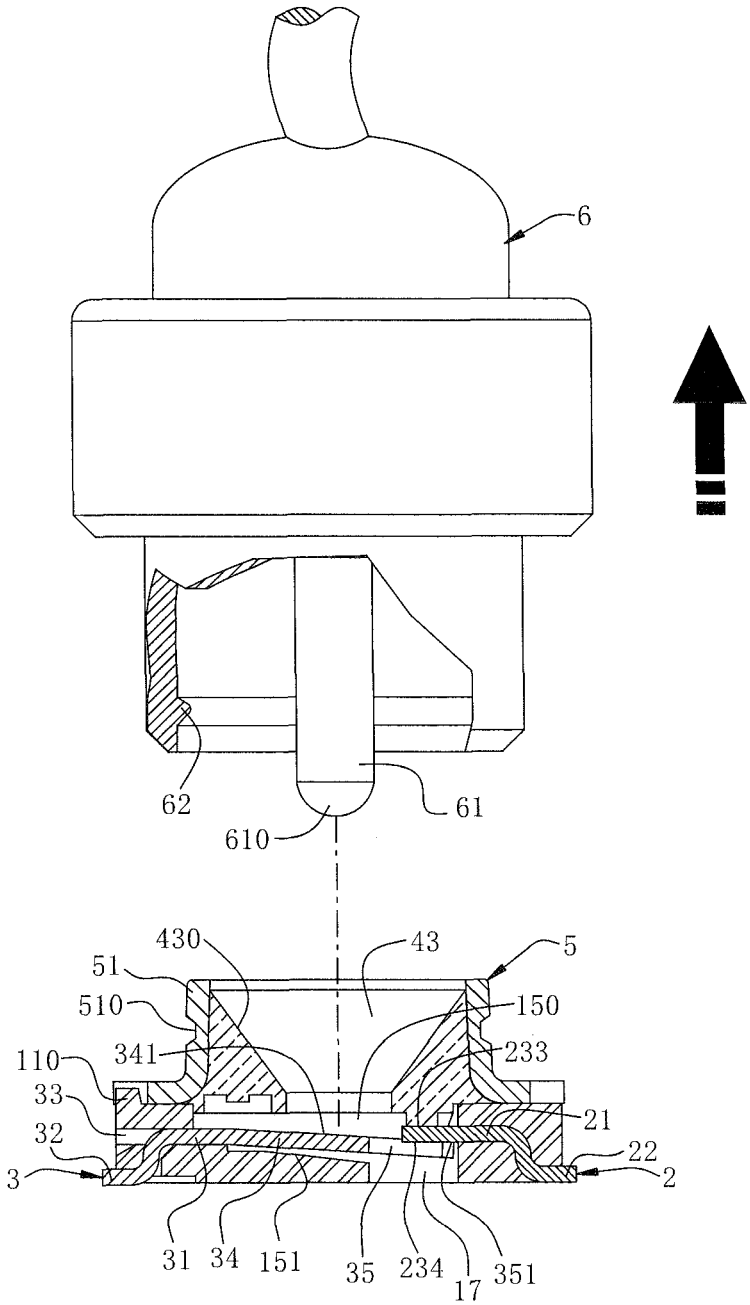
FIG. 7 is a sectional view of FIG. 6.

Referring to FIGS. 1 and 3, the casing 5 is formed by stamping a metal material, and includes a sleeve portion 51 and a plate portion 52 disposed in an upper-lower manner. Likewise, the sleeve portion 51 smoothly transitions to and is vertically coupled to the plate portion 52. The sleeve portion 51 is provided with a buckling portion 510 for buckling the external device 6, and the buckling portion 510 is an annular groove located at a periphery of the sleeve portion 51. Left and right sides of the plate portion 52 are respectively recessed inwards to form a recess 520 longer than the reinforcing rib 110. Front and rear sides of the plate portion 52 are respectively bent downwards and extend to from a wrapping portion 521, where the wrapping portion 521 is in a C-shape when viewed from the side, and has a bottom plate surface parallel to the plate portion 52.

Referring to FIG. 3, the external device 6 includes a pin 61 and an annular fastening portion 62, and one end of the pin 61 is provided with a pressing portion 610.

Referring to FIGS. 1-3, during assembly, first, the first terminal 2 is integrally formed with the insulating body 1. That is, the first terminal 2 is inserted and molded within the insulating body 1, so that the first contact portion 23 enters the receiving cavity 15, the first soldering portion 22 is exposed out of the right side surface of the insulating body 1, and the bottom surface of the first soldering portion 22 is in the same horizontal plane as the bottom surface 12. Afterwards, the second terminal 3 is inserted into the insulating body 1 from the left, so that the second contact portion 34 passes through the accommodating hole 16 to enter the receiving cavity 15. The fixing portion 33 is retained within the accommodating hole 16, the second soldering portion 32 is exposed out of the left side surface of the insulating body 1, and the bottom surface of the second soldering portion 32 is also in the same horizontal plane as the bottom surface 12. In this way, an operation of mounting and fixing the first terminal 1 and the second terminal 2 into the receiving cavity 15 is substantially completed.

Referring to FIGS. 1-3, specifically, in this embodiment, in the process of installing the second terminal 3, the two fingers 35 slide over the two guiding surfaces 232, and the two fingers 35 are pressed by the first contact portion 23 to be slightly pushed apart from each other, till the two clamping portions 351 on the two fingers 35 clamp the two pressed portions 231, so that the two second contact portions 34 clamp the first contact portion 23, and at this time, the first contact portion 23 and the second contact portion 34 are maintained in the same horizontal plane. In other embodiments, after the second terminal 3 is installed, the second contact portion 34 may be jointed to the lap joint portion 233. That is, the second contact portion 34 may be lap jointed on the top surface of the first contact portion 23. At this time, the second contact portion 34 is slightly inclined upwards and lap joined to the first contact portion 23. Alternatively, the second contact portion 34 does not contact the lap joint portion 233 and is suspended above the first contact portion 23. In addition, in other embodiments, the second terminal 3 may be in an L-shape or other shapes, the second terminal 3 may have only one second contact portion 34, and the second contact portion 34 may laterally urge against the first contact portion 23. Before the external device 6 is inserted into the coaxial connector 100 for the first time, the positions of the first contact portion 23 and the second contact portion 34 are as described above, which may be defined as a first relative positional relationship.

Referring to FIGS. 1-3, then, the top cover 4 is integrally formed with the casing 5, that is, the cylinder 41 is inserted and molded within the sleeve portion 51, so that the two positioning blocks 421 is installed in the receiving cavity 15 corresponding to the two chamfers 152, the recess 520 is mounted around the reinforcing rib 110, and the wrapping portion 521 is wrapped in the notch 18, thereby integrally mounting and fixing the top cover 4 and the casing 5 onto the insulating body 1. The casing 5 generally has a grounding function, and an outer surface of the casing 5 is plated as required.

Referring to FIGS. 1-3, afterwards, the assembled coaxial connector 100 is placed in a high-temperature soldering stove, so as to solder the first soldering portion 22 and the second soldering portion 32 to the circuit board (not shown), so that the coaxial connector 100 is fixed to the circuit board (not shown) by soldering. In this process, due to the high temperature inside the soldering stove, the insulating body 1 is easily softened under heat. In this embodiment, before the coaxial connector 100 is fixed to the circuit board (not shown) by soldering, and further, before the external device 6 is inserted into the coaxial connector 100 for the first time, the second contact portion 34 clamps the first contact portion 23, which avoids the phenomenon that when the second terminal 3 is inclined downwards or falls down due to plastic softening, the normal force for enabling the second terminal 3 to urge against the first terminal 2 is insufficient and results in poor contact.

In other embodiments, before the coaxial connector 100 is fixed to the circuit board (not shown) by soldering, and further, before the external device 6 is inserted into the coaxial connector 100 for the first time, the second contact portion 34 is lap joined on the top surface of the first contact portion 23, or the second contact portion 34 is suspended above the first contact portion 23, or the second contact portion 34 laterally urges against the first contact portion 23, so that the second terminal 3 is prevented from being inclined downwards or falling down due to plastic softening to affect the electrical conduction function of the coaxial connector 100. From another perspective, before the external device 6 is inserted into the coaxial connector 100 for the first time, the first contact portion 23 and the second contact portion 34 form the first relative positional relationship, which can prevent the second terminal 3 from being inclined downwards or falling down due to plastic softening to affect the electrical conduction function of the coaxial connector 100.

Referring to FIGS. 1 and 4-7, after the coaxial connector 100 is fixed to the circuit board (not shown) by soldering, and when the external device 6 is inserted downwards into the coaxial connector 100 for the first time, the fastening portion 62 is buckled and fastened to the buckling portion 510, and at the same time, the pin 61 passes through the coupling hole 43 and the inserting interface 150 to enter the receiving cavity 15, the pressing portion 610 urges against the third urging portion 341 (that is, the external device 6 presses against the second contact portion 34), and drives the second contact portion 34 to undergo a downward displacement. The second contact portion 34 is elastically deformed downwards, and moves across the first contact portion 23 after scratching the first contact portion 23, so that the second contact portion 34 is located below the first contact portion 23, till the second terminal 3 is detached from the first terminal 2 to form an open circuit, and at this time, it is defined that the first contact portion 23 and the second contact portion 34 form a second relative positional relationship. In addition, at this time, the two second contact portions 34 at the free end of the second contact portion 34 elastically restore the natural state before being pressed by the first contact portion 23. As such, no matter whether the external device 6 is a test probe or other conductive or nonconductive element similar to a probe, the first relative positional relationship between the first contact portion 23 and the second contact portion 34 can be changed to the second relative positional relationship once the first insertion operation is completed.

Referring to FIGS. 1 and 4-7, next, the pin 61 is pulled out of the coaxial connector 100 upwards (that is, the external device 6 is disengaged from the coaxial connector 100). At this time, the second contact portion 34 elastically restores upwards as no external force is applied thereto, and then the second urging portion 351 urges against the first urging portion 234, that is, the second contact portion 34 urges against the first contact portion 23 upwards to form a third relative positional relationship, so that an urging state between the first contact portion 23 and the second contact portion 34 before soldering is changed. That is, the relative positional relationship between the first contact portion 23 and the second contact portion 34 before soldering is changed. Referring to FIGS. 2, 3, 6 and 7, it is evident that the first relative positional relationship and the third positional relationship are different positional relationships, and in other words, the third relative positional relationship is different from the first relative positional relationship.

Referring to FIGS. 1 and 4-7, afterwards, each time when the external device 6 is inserted into the coaxial connector 100, the second contact portion 34 is detached from the first contact portion 23 to form an open circuit (that is, the second relative positional relationship is formed). Each time when the external device 6 is disengaged from the coaxial connector 100, the second contact portion 34 urges against the first contact portion 23 upwards (that is, the third relative positional relationship is formed). From another perspective, the second contact portion 34 urges against the first contact portion 23 upwards, so that a prestress is formed between the first terminal 2 and the second terminal 3, which provides a normal force for enabling the first contact portion 23 to urge against the second contact portion 34, and further, provides a normal force for enabling the second contact portion 34 to urge against the first contact portion 23 upwards. In this way, when the coaxial connector 100 is in operation, electrical connection between the first contact portion 23 and the second contact portion 34 is maintained by the normal force, thereby maintaining electrical conduction between the first terminal 2 and the second terminal 3.

Although a coaxial connector having a switch for use in high frequency circuits has been described above, the present invention is not limited thereto, but is also applicable to other electrical connectors, and particularly to electrical connectors that cannot achieve normal conduction due to an insufficient contact normal force between terminals when a terminal thereof is inclined downwards or falls down due to plastic softening.

Based on the above, the coaxial connector and a method for providing a normal force in an electrical connector according to the present invention, among other things, has the following beneficial effects.

1. Before the coaxial connector 100 is fixed to the circuit board (not shown) by soldering, and further, before the external device 6 is inserted into the coaxial connector 100 for the first time, the first contact portion 23 and the second contact portion 34 form the first relative positional relationship, that is, the second contact portion 34 clamps the first contact portion 23, or the second contact portion 34 is lap joined on the top surface of the first contact portion 23, or the second contact portion 34 is suspended above the first contact portion 23, or the second contact portion 34 laterally urges against the first contact portion 23, so that the second terminal 3 is prevented from being inclined downwards or falling down when the insulating body 1 is softened under heat during soldering, so as to ensure a sufficient contact normal force between the first terminal 2 and the second terminal 3, thereby achieving good electrical conduction during normal operation.

2. When the external device 6 is inserted into the coaxial connector 100, the pressing portion 610 pushes the third urging portion 341 so that the second terminal 3 is displaced downwards, and moves across the first terminal 2 after scratching the first terminal 2. In the scratching process, foreign matters such as solder flux attached to the edge of the second contact portion 34 and the edge of the first contact portion 23 during soldering can be removed, thereby improving the conduction between the first terminal 2 and the second terminal 3.

3. The first terminal 2 is integrally formed with the insulating body 1, and then the second terminal 3 is inserted. In addition, the top cover 4 is also integrally formed with the casing 5, and then mounted and fixed onto the insulating body 1 to complete the assembly. Therefore, the whole assembling process is simplified and the assembling efficiency can be improved.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A coaxial connector, for being soldered to a circuit board and capable of receiving an external device to be inserted therein, comprising:

a receiving cavity, having an inserting interface for receiving the external device to be inserted therein;

a first terminal, mounted and fixed within the receiving cavity, and having a first soldering portion and at least one first contact portion, wherein the first soldering portion is used for being soldered to the circuit board; and a second terminal, mounted and fixed within the receiving cavity, and having a second soldering portion and at least one second contact portion, wherein the second soldering portion is used for being soldered to the circuit board, wherein, before the external device is inserted into the coaxial connector for the first time, the first contact portion and the second contact portion form a first relative positional relationship;

when the external device is inserted into the coaxial connector, the external device presses against and contacts the second contact portion downwards, so that the second contact portion is detached from the first contact portion, and the first contact portion and the second contact portion form a second relative positional relationship; and after the external device is disengaged from the coaxial connector, the second contact portion urges against the first contact portion upwards to form a third relative positional relationship, wherein the third relative positional relationship is different from the first relative positional relationship.

2. The coaxial connector according to claim 1, wherein the first relative positional relationship is that the second contact portion clamps the first contact portion.

3. The coaxial connector according to claim 2, wherein a front end of the second contact portion is provided with two fingers, and the first relative positional relationship is that the two fingers clamp the first contact portion.

4. The coaxial connector according to claim 1, wherein the first relative positional relationship is that the second contact portion is lap joined on a top surface of the first contact portion.

5. The coaxial connector according to claim 1, wherein the first relative positional relationship is that the second contact portion laterally urges against the first contact portion.

6. The coaxial connector according to claim 1, wherein the first relative positional relationship is that the second contact portion is suspended above the first contact portion.

7. An electrical connector, comprising:

a receiving cavity; and a first terminal and a second terminal, respectively mounted within the receiving cavity, the first terminal having at least one first contact portion, and the second terminal having at least one second contact portion, wherein a front end of the at least one second contact portion forms a C-shaped opening with two fingers, two clamping portions are disposed on inner side surfaces of the two fingers; and wherein, after the electrical connector is fixed to a circuit board by soldering, a relative positional relationship between the first contact portion and the second contact portion before soldering is changed, a distance between the two clamping portions is smaller than a width of a corresponding part of the at least one first contact portion, and a prestress is formed between the first contact portion and the two fingers of the second contact portion, so as to provide a normal force for enabling the first contact portion to urge against the second contact portion,-so that electrical connection between the first contact portion and the second contact portion is maintained by the normal force during operation of the electrical connector.

8. The electrical connector according to claim 7, wherein after the relative positional relationship between the first contact portion and the second contact portion before soldering is changed, the second contact portion urges against the first contact portion upwards.

9. The electrical connector according to claim 7, wherein the electrical connector is used for receiving an external device to be inserted therein, and when the external device is inserted into the electrical connector, the second contact portion is detached from the first contact portion to form an open circuit; and after the external device is disengaged from the electrical connector, the second contact portion urges against the first contact portion upwards.

10. The electrical connector according to claim 7, wherein before the electrical connector is fixed to the circuit board by soldering, the second contact portion clamps the first contact portion.

11. The electrical connector according to claim 7, wherein before the electrical connector is fixed to the circuit board by soldering, the second contact portion is lap joined on the first contact portion.

12. The electrical connector according to claim 7, wherein before the electrical connector is fixed to the circuit board by soldering, the second contact portion is suspended above the first contact portion.

13. The electrical connector according to claim 7, wherein before the electrical connector is fixed to the circuit board by soldering, the second contact portion laterally urges against the first contact portion.

14. A method for providing a normal force in an electrical connector, the electrical connector comprising a first terminal and a second terminal, the first terminal having at least one first contact portion, and the second terminal having at least one second contact portion, comprising:

fixing the electrical connector to a circuit board by soldering, such that the at least one first contact portion and the at least one second contact potion are in a first state, wherein in the first state, the first contact portion and the second contact portion are substantially horizontal to each other;

changing an urging state between the first contact portion and the second contact portion from a first state before soldering to a second state, wherein in the second state, the second contact portion urges against a bottom surface of the first contact portion; and forming a prestress between the first terminal and the second terminal in the second state, so as to provide a normal force for maintaining electrical connection between the first contact portion and the second contact portion during operation of the electrical connector, wherein the operation of the electrical connector comprises switching the first contact portion and the second contact portion between the second state and a third state, and in the third state, the first contact portion is disengaged from the second contact portion.

15. The method for providing a normal force in an electrical connector according to claim 14, wherein after the electrical connector is fixed to a circuit board by soldering, the urging state between the first contact portion and the second contact portion before soldering is changed by inserting an external device for the first time.

16. The method for providing a normal force in an electrical connector according to claim 14, wherein after the urging state between the first contact portion and the second contact portion before soldering is changed, the second contact portion urges against the first contact portion upwards, so as to form the prestress between the first terminal and the second terminal.

17. The method for providing a normal force in an electrical connector according to claim 14, wherein the electrical connector is used for receiving an external device to be inserted therein, and when the external device is inserted into the electrical connector, the second contact portion is detached from the first contact portion to form an open circuit;

and after the external device is disengaged from the electrical connector, the second contact portion urges against the first contact portion upwards.

* * * * *